US005373989A

United States Patent [19]

Hattori

[11] Patent Number: 5,373,989

[45] Date of Patent: Dec. 20, 1994

[54] SPRINKLER HEAD HAVING A CHECKING MEANS FOR CHECKING THAT FLUID HAS BEEN FILLED INSIDE OF A SPRINKLER HEAD BODY AND METHOD FOR CHECKING THAT THE FLUID HAS BEEN FILLED USING SUCH SPRINKLER HEAD

[76] Inventor: Takamasa Hattori, 1-5-14 Kibougaoka Kumatori-cho, Sennan-gun, Osaka, Japan

[21] Appl. No.: 149,826

[22] Filed: Nov. 10, 1993

[30] Foreign Application Priority Data

| | | | |
|---|---|---|---|
| Nov. 11, 1992 | [JP] | Japan | 4-301259 |
| Dec. 28, 1992 | [JP] | Japan | 4-349221 |
| May 26, 1993 | [JP] | Japan | 5-124471 |

[51] Int. Cl.[5] ..... A62C 37/12

[52] U.S. Cl. ..... 239/71; 169/37; 116/272

[58] Field of Search ..... 239/71, 74, 75; 169/37–41, 91; 116/272, 268

[56] References Cited

U.S. PATENT DOCUMENTS

| | | | |
|---|---|---|---|
| 2,827,122 | 3/1958 | Clark | 116/272 |
| 3,181,496 | 5/1965 | Bilbrey | 116/272 |
| 3,691,981 | 9/1972 | Rao | 116/272 |
| 3,874,455 | 4/1975 | Klesow | 169/37 |
| 4,099,573 | 7/1978 | Sahara | 169/37 |
| 4,134,458 | 1/1979 | Kimura | 169/37 |
| 4,434,855 | 3/1984 | Given, Jr. | 169/37 |
| 5,184,683 | 2/1993 | Takamasa | 169/37 |

FOREIGN PATENT DOCUMENTS

| | | | |
|---|---|---|---|
| 67995 | 6/1978 | Japan | 169/37 |
| 2215058 | 9/1989 | United Kingdom | 116/272 |
| 1553152 | 3/1990 | U.S.S.R. | 169/37 |

*Primary Examiner*—Karen B. Merritt

*Attorney, Agent, or Firm*—Nikaido, Marmelstein, Murray & Oram

[57] ABSTRACT

A sprinkler head includes a checking mechanism for checking from the outside that fluid such as fire protection water has been filled inside of a sprinkler head body. A method for checking that the fluid such as fire protection water has been filled includes providing a movable rod inside of the sprinkler head body in such a manner as to be axially moved inwardly and outwardly when the fluid has been filled inside of the sprinkler head body, and checking that the fluid has been filled inside of the sprinkler head body by observing a position of the movable rod from the outside.

13 Claims, 9 Drawing Sheets

SPRINKLER HEAD HAVING A CHECKING MEANS FOR CHECKING THAT FLUID HAS BEEN FILLED INSIDE OF A SPRINKLER HEAD BODY AND METHOD FOR CHECKING THAT THE FLUID HAS BEEN FILLED USING SUCH SPRINKLER HEAD

BACKGROUND OF THE INVENTION

This invention relates to a sprinkler head having a checking means for checking that fluid has been filled inside of the sprinkler head body and a method for checking that the fluid has been filled using such sprinkler head.

There are hitherto sprinkler heads of this type. An example is described in the specification of Japanese Utility Model Laid-Open No. 2-109661 filed by the applicant of the present invention, as illustrated in FIG. 9. The sprinkler head described therein is characterized in that a plug 4 is pushed upwardly and is maintained at a position so as to close an outlet port 5 of a head frame 1. The sprinkler head of this arrangement is generally mounted on a ceiling plane of a room or the like in a state where fire protection water is filled inside of the head frame 1 such that the sprinkler head can sprinkle the fire protection water once fire has occurred.

However, since such conventional plug 4 merely serves to close the outlet port 5 of the head frame 1, the filled state of the fire protection water inside of the sprinkler head body 27 could not be checked from the outside, which presents an inherent disadvantage. Therefore, when the fire protection water is not filled inside of the sprinkler head body 27 due to an insufficient connecting of distributing water pipes or other accidents in communicating the fluid, such undesirable state can not be found before the fire occurs, which causes serious troubles in extinguishing the fire with the sprinkler head.

SUMMARY OF THE INVENTION

Therefore, it is an object of the present invention to provide a sprinkler head and a method for enabling a user to readily check from the outside that fluid has been filled inside of a sprinkler head body, and to find the insufficient connecting of distributing water pipes or the like.

In accordance with the present invention, there is provided a sprinkler head having a checking means for checking from outside that fluid has been filled inside of the sprinkler head body.

There is further provided a method for checking that fluid has been filled comprising providing a movable rod inside of the sprinkler head body in such a manner as to be moved when the fluid has been filled inside of the sprinkler head body, and checking that the fluid has been filled inside of the sprinkler head body by observing a position of the movable rod from the outside.

Accordingly, in the sprinkler head and the method of the present invention, the filled state of the fluid inside of the sprinkler head body can readily be checked from the outside.

Various other objects, features and attendant advantages of the present invention will be more fully appreciated as the same becomes better understood from the following detailed description when considered in connection with the accompanying drawings in which like reference characters designate like or corresponding parts throughout the several views and wherein:

DETAILED DESCRIPTION OF THE PREFERRED EMBODIMENTS

Figure 1:
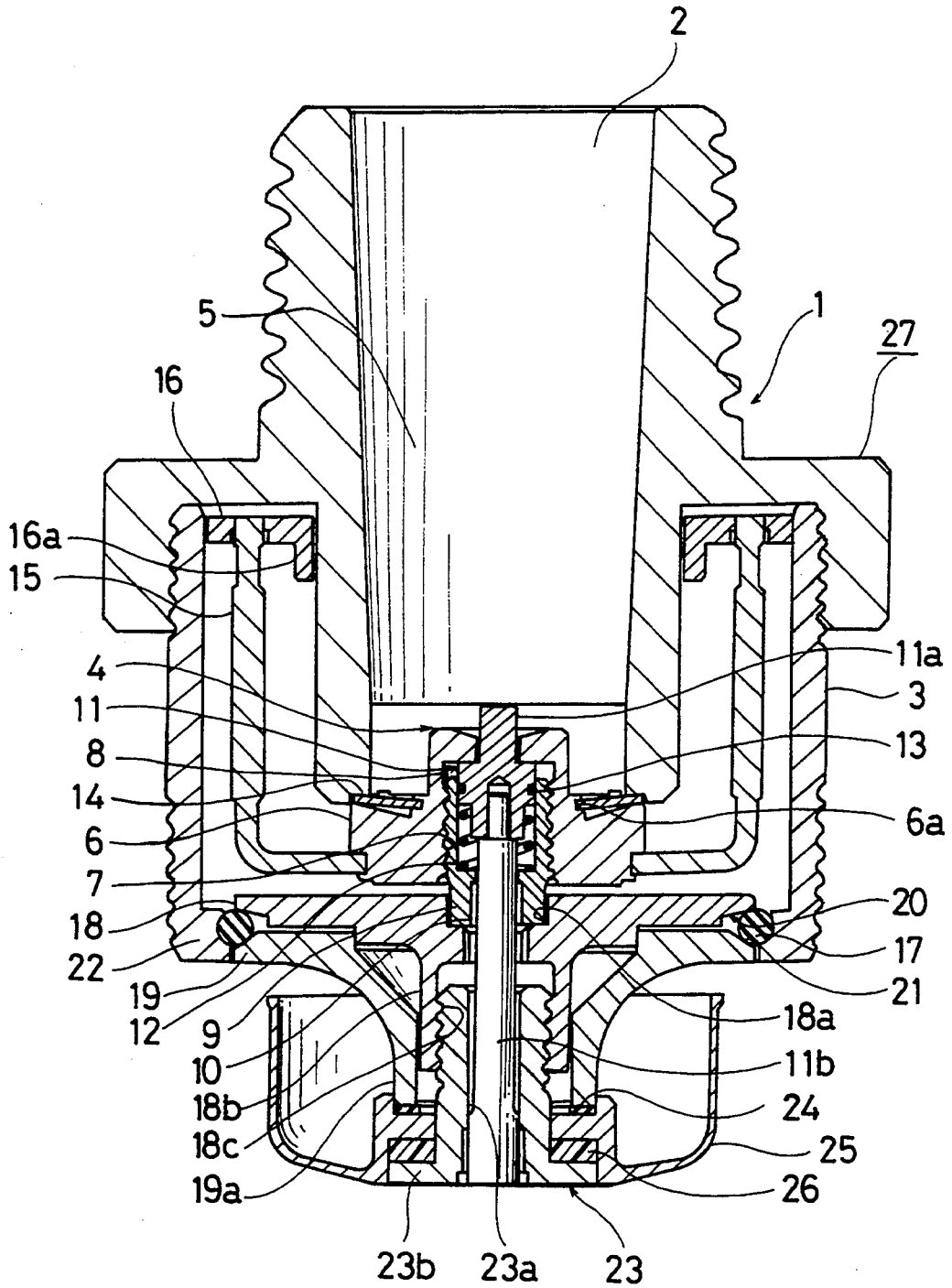
FIG. 1 is a sectional view illustrating one embodiment of the present invention.
Figure 2:
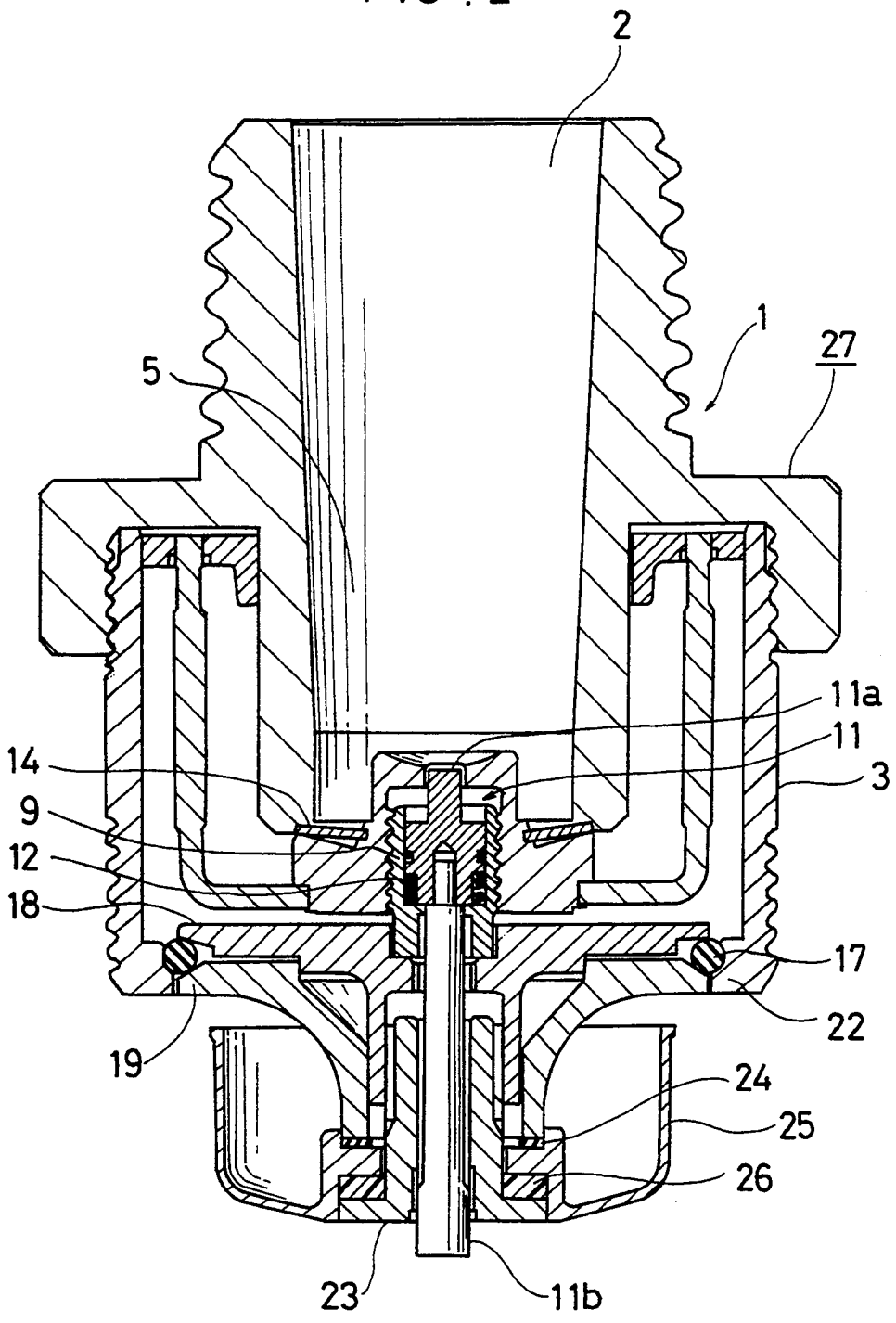
FIG. 2 is a sectional view illustrating one of the operational steps of the sprinkler head of FIG. 1.

FIG. 1 illustrates the first embodiment of the present invention. A head frame 1 is provided therein with a passageway 2 for fire protection water. A frame 3, having a substantially cylindrical shape, is threaded into an annular concaved portion of the head frame 1.

A plug 4 is provided on its lower periphery with a collar portion 6, and is arranged inside of a sprinkler head body 27 so as to close an outlet port 5 defined in a lower portion of the head frame 1. A through-hole 8 is defined in a substantially center of the plug 4. Internal threads 7 are formed on an internal periphery of a lower portion of the through-hole 8. A diameter of the inward end of the through-hole 8 is smaller than that of the other portion of the through-hole 8.

An externally threaded portion 9 is threaded into the internal threads 7. A through-hole 10 with its lower portion of hexagonal shape is defined in a substantially center of the externally threaded portion 9 and is in fluid communication with the through-hole. A sealing means (not shown) is applied between the externally threaded portion 9 and the internal threads 7 of the plug 4.

A spring member 14, consisting of a belleville spring coated with fluoroplastic, is provided between a lower end of the outlet port 5 of the head frame 1 and an upper surface of the collar portion 6 of the plug 4, and is urged by a predetermined pressure. An inner periphery of the spring member 14 is fitted in an internally extending annular groove **6*a* which is defined in the collar portion 6 of the plug 4**.

A plurality of deflectors 15, each of which having a bent portion, are connected to an outer periphery of the lug 4. A guide ring 16, having a guide member **16*a* which is vertically oriented and slidably abuts against an outer surface of the head frame 1, is connected to an upper end of the deflectors 15 so as to serve as a guide when the plug 4 falls down. A detent member 17** is formed in a partially cutaway ring-shape, and is elastically deformable so as to diametrally expand and contract.

A pair of restraining members 18, 19 are arranged so as to restrain the detect member 17. A hole **18*a* is defined in an upper surface of the upper restraining member 18 such that a lower portion of the externally threaded portion 9 can be inserted into that hole 18***a*. A cylindrical portion 18*b* of the upper restraining member 18 is provided on its inner periphery with internal threads 18*c*, that is slidably inserted into a cylindrical portion 19*a* of the lower restraining member 19. An upwardly sloped surface 20 and a downwardly sloped surface 21 are respectively defined on the restraining members 18, 19. The sloped surfaces 20, 21 come closer to each other as they advance inwardly so as to hold the detent member 17 in tensioned state. The detent member 17 is held between the sloped surfaces 20, 21, and an inner periphery of an inwardly projecting portion 22 defined on an inner periphery of the lower portion of the head frame 1.

A lock screw 23 is threaded into the internal threads 18*c* of the upper restraining member 18. A through-hole 23*a* is defined coaxially in a center portion of the lock screw 23. On a lower surface of the lower restraining member 19 is provided a thermal insulating packing 24, on which a thermal sensitive member 25 is provided. A head meltable member 26 is provided between the thermal sensitive member 25 and an outwardly extending flange 23*b* formed on a lower end of the lock screw 23 in heat conductive relationship with the thermal sensitive member 25.

A movable rod 11 has a rod-shaped projection 11*a* on its upper end, a pin 11*b* on its lower end, and is inserted into a bore of the externally threaded portion 9 via an elastic member 12 consisting of a coil spring so as to be axially moveable inwardly and outwardly. The movable rod 11 is usually urged in an inward direction by the elastic member 12 such that a lower end of the pin 11*b* becomes flush with a lower surface of the lock screw 23 which defines some region of a lower surface of the sprinkler head 27, as illustrated in FIG. 1. On a side periphery of the pin 11*b* closer to the lower end thereof is applied fluorescent paint.

An O-ring 13 seal is mounted to an outer periphery of the movable rod 11 for sealing between an inner periphery of the externally threaded portion 9 and an outer periphery of the movable rod 11.

The application of the sprinkler head in accordance with this embodiment, which includes the sprinkler head body 27 and the movable rod 11, will be described hereinbelow.

First, the sprinkler head is fixed at a predetermined position on a ceiling plane. The sprinkler head is connected with a distributing water pipe (not shown) through a connecting pipe (not shown). Then, the fire protection water is communicated with the distributing water pipe. In this regard, when the fire protection water has been filled inside of the sprinkler head body 27, the movable rod 11 is moved outwardly by the pressure of the fire protection water applied thereover, while resisting the spring force of the elastic member 12, and consequently the pin 11*b* protrudes outwardly away from the lower surface of the lock screw 23.

On the other hand, when the fire protection water has not been sufficiently filled or it has not been filled at all inside of the sprinkler head body 27, the pin 11*b* of the movable rod 11 does not protrude sufficiently or it does not protrude at all to the outside. The filled state of the fire protection water inside of the sprinkler head body can be checked by observing a position of the pin 11*b* in this manner. In addition, since the fluorescent paint is applied over the side periphery of the lower end of the pin 11*b*, the position of the pin 11*b* can be observed at night or the like.

Accordingly, insufficiently connected portions of the pipes can be found previously. And when the fire protection water has not been sufficiently filled inside of the sprinkler head body 27, the filled state of the water is checked again after checking the piping or the like.

As a further advantage of the present invention, the sprinkler head with such a simple construction can be manufactured readily in an inexpensive manner.

Once the fire has occurred and caused the thermal sensitive member 25 to increase its temperature, the heat meltable member 26 is melted or softened, and the lower restraining member 19 moves outwardly. Then, the detent member 17 is contacted inwardly, and is released from the locking relationship with the inwardly projecting portion 22 of the frame 3. The upper restraining member 18, the externally threaded portion 9 and the plug 4 fall down to the lower direction of the head frame 1 by the spring force of the spring member 14. Consequently, the fire protection water is flashed from the outlet port which has been opened, collides against an upper surface of the plug 4, and is sprinkled radially.

In this embodiment, the pin 11*b* generally becomes flush with the lower surface of the lock screw 23 by urging the movable rod 11 with the elastic member 12. However, the whole length of the pin 11*b* can be positioned inside of the lock screw. Or a relatively short length thereof can be positioned outside of the lock screw 23. It is essential that the filled state of the fluid such as the fire protection water inside of the sprinkler head body 27 can be checked by arranging the movable rod 11 so as to protrude to the outside after the fluid has been filled inside of the sprinkler head body 27.

Figure 3:
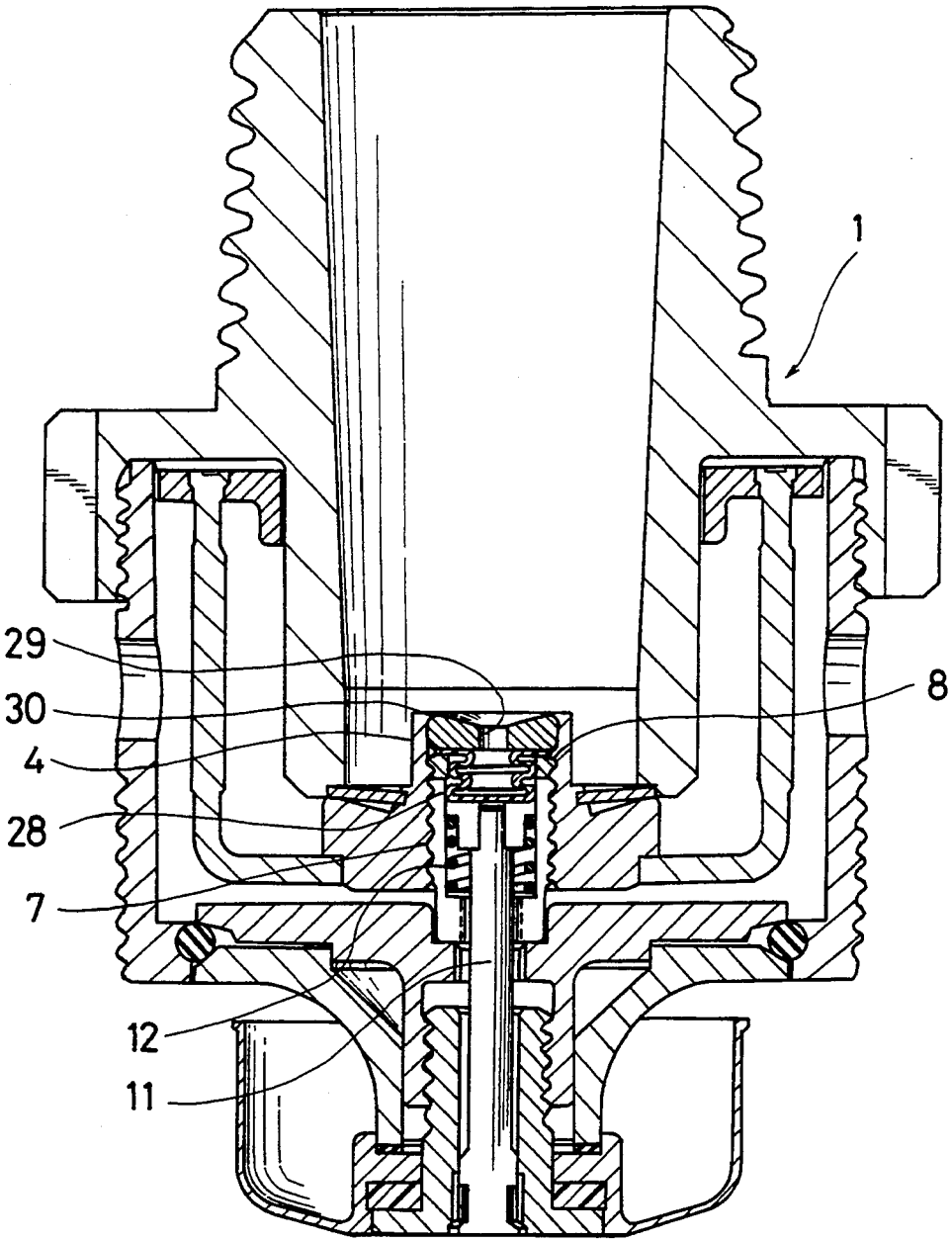
FIG. 3 is a sectional view illustrating a further embodiment of the present invention.

In addition, the present invention is not limited to the sprinkler head of the above embodiment. It can be applied to a sprinkler head as illustrated in FIG. 3, in which a flexible bellows 28 with a bottom wall disposed on a lower end thereof is mounted in the through-hole 8 of the plug 4, with abutting against the upper end of the movable rod 11, and a covering member having a through-hole 29, is threads into the internal threades 7 of the through-hole 8. Further, it can be applied to a dry sprinkler head where gas such as air is filled inside of the sprinkler head body 27.

Contrary to the first embodiment where the movable rod 11 protrudes outwardly when the fire protection water has been filled inside of the sprinkler head body 27, in a second embodiment which will be described hereinbelow, the movable rod 11 is introduced into the sprinkler head body 27.

Since, the main features of the sprinkler head of the second embodiment is same as that of the first embodiment, only different features between the embodiments will be described hereinbelow.

Figure 4:
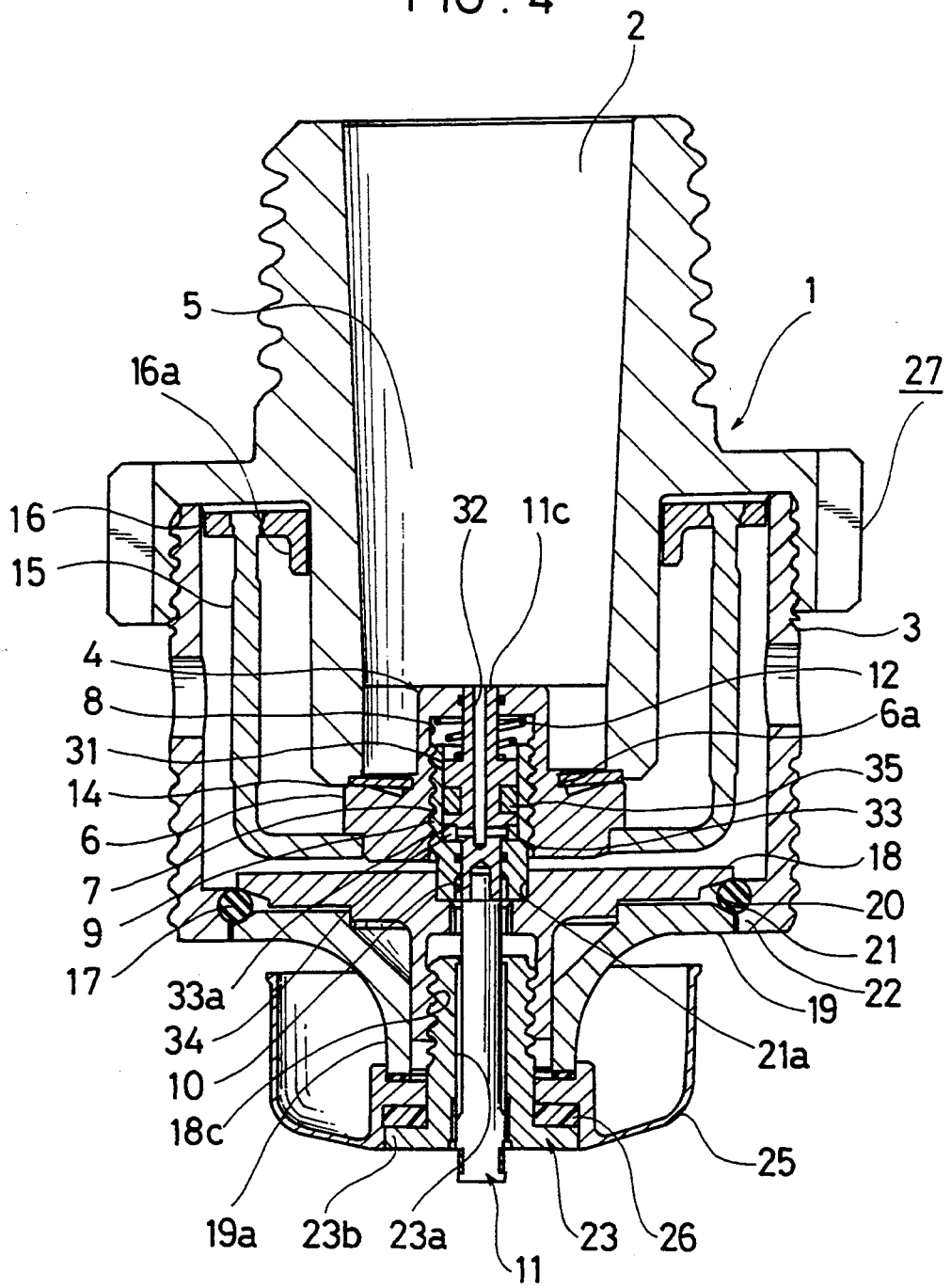
FIG. 4 is a sectional view illustrating a further embodiment of the present invention.
Figure 5:
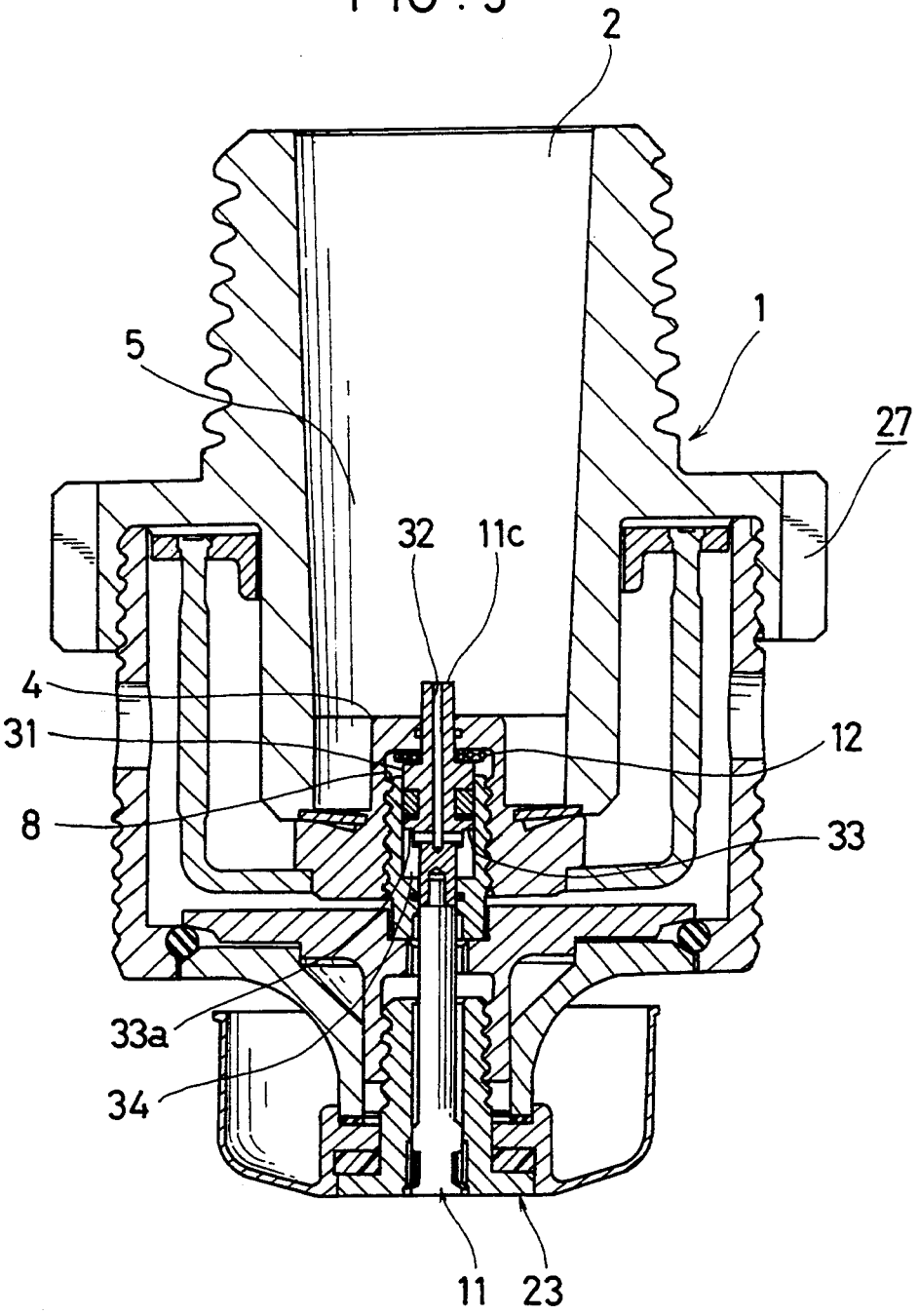
FIG. 5 is a sectional view illustrating one of the operational steps of the sprinkler head of FIG. 4.

Referring to FIG. 4, the movable rod 11 is provided on its upper end with a movable member 31 which is slidably inserted into the through-hole 10 of the externally threaded portion 9. The movable rod 11 is usually tensioned outwardly as a usual state with the elastic member 12 of the coil spring, and the lower end of the movable rod 11 protrudes outwardly away from the lower surface of the lock screw 23. The lower end surface of the movable rod 11 is painted with the fluorescent paint (not shown).

A passageway 32 is coaxially defined in a center of the movable member 31. A lower end of the passageway 32 is divided into several passageways, each of which extends in a radial direction. The divided passageways communicate with a space 34 defined by an inner periphery of the through-hole 10 of the externally threaded portion 9 and a stepped portion 33 of the movable member 31 in fluid communication with each other. A ring seal 35 of X-shape in cross section is mounted between the externally threaded portion 9 and the movable member 31. An upper surface 33*a* of the stepped portion 33 of the movable member 31 is larger than an upper surface 11*c* of the movable rod 11.

In the sprinkler head according to the above-defined arrangement, when the fire protection water has been filled inside of the sprinkler head body 27, it is introduced into the space 34 via the passageway 32 of the movable rod 11, and its pressure is applied over the upper surface 33*a* of the stepped portion 33. Then, the movable rod 11 is forced to move inwardly by the pressure of the fire protection water, while resisting the spring force of the elastic member 12, since the upper surface 33*a* is larger than the upper surface 11*c* of the movable rod 11. Whereby, the movable rod 11 is drawn into the sprinkler head body 27 such that the lower surface of the movable rod 11 becomes flush with the lower surface of the lock screw 23.

On the other hand, when the fire protection water has not been filled inside of the sprinkler head body 27, the movable rod 11 does not move inwardly, and a partially protruded portion of which is maintained in an initial position. Whereby, the unfilled state of the fire protection water can be readily checked by observing such position of the movable rod 11 from the outside, and subsequently the insufficient connecting of the pipes or other accidents in communicating the fluid can be found before the fire occurs.

As in the first embodiment, the arrangement of this embodiment can be applied to the dry sprinkler head, in which gas such as air is filled inside of the head frame 1.

In the first and second embodiments, the filled state of the fire protection water inside of the sprinkler head body 27 can be checked by observing the motion of the movable rod 11 from the outside. However, the filled state can be checked by a different means described in the third embodiment.

In the third embodiment, the main features of the sprinkler head is also same as that of the first embodiment. Therefore, only different features between the embodiments will be described hereinbelow.

Figure 6:
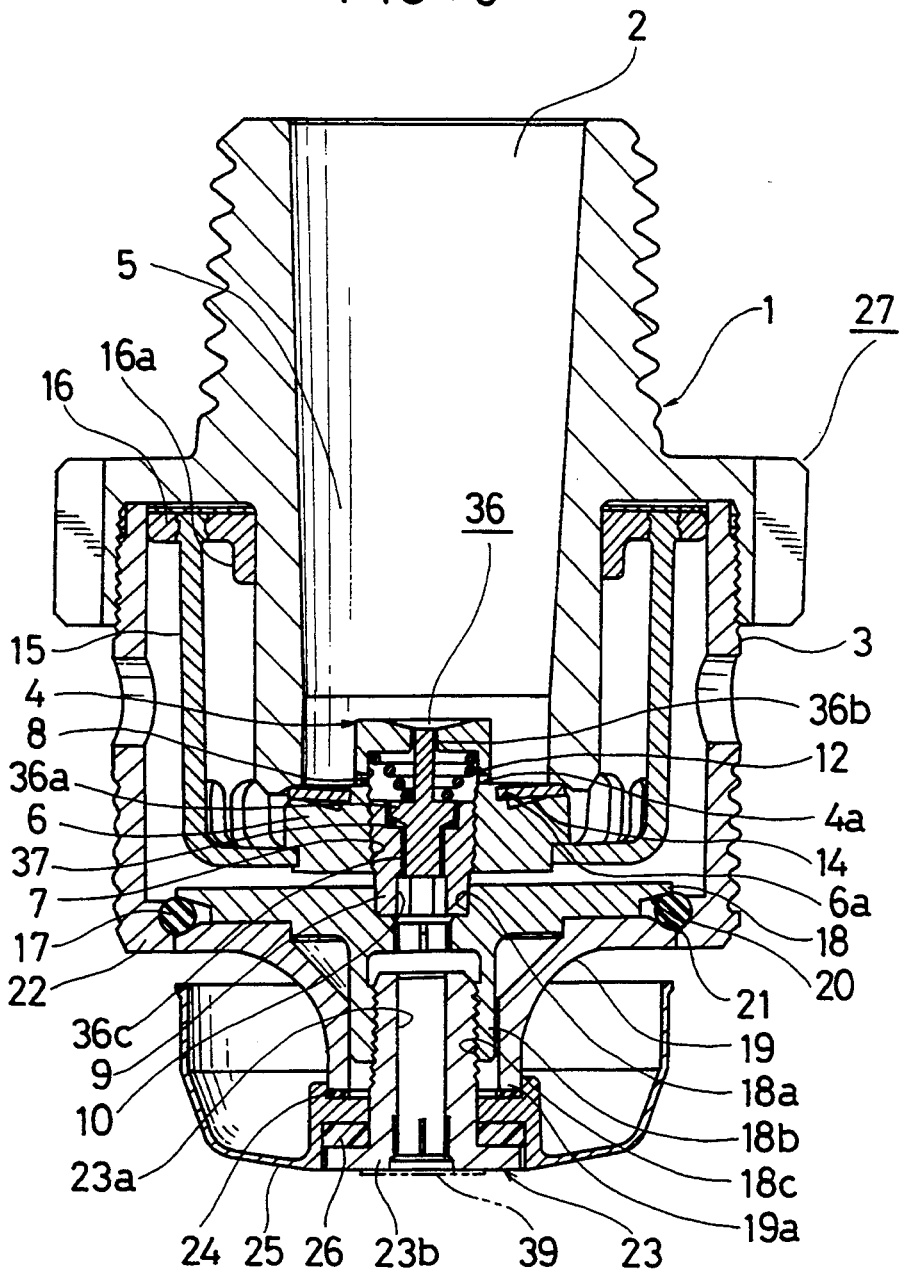
FIG. 6 is a sectional view illustrating a further embodiment of the present invention.
Figure 7:
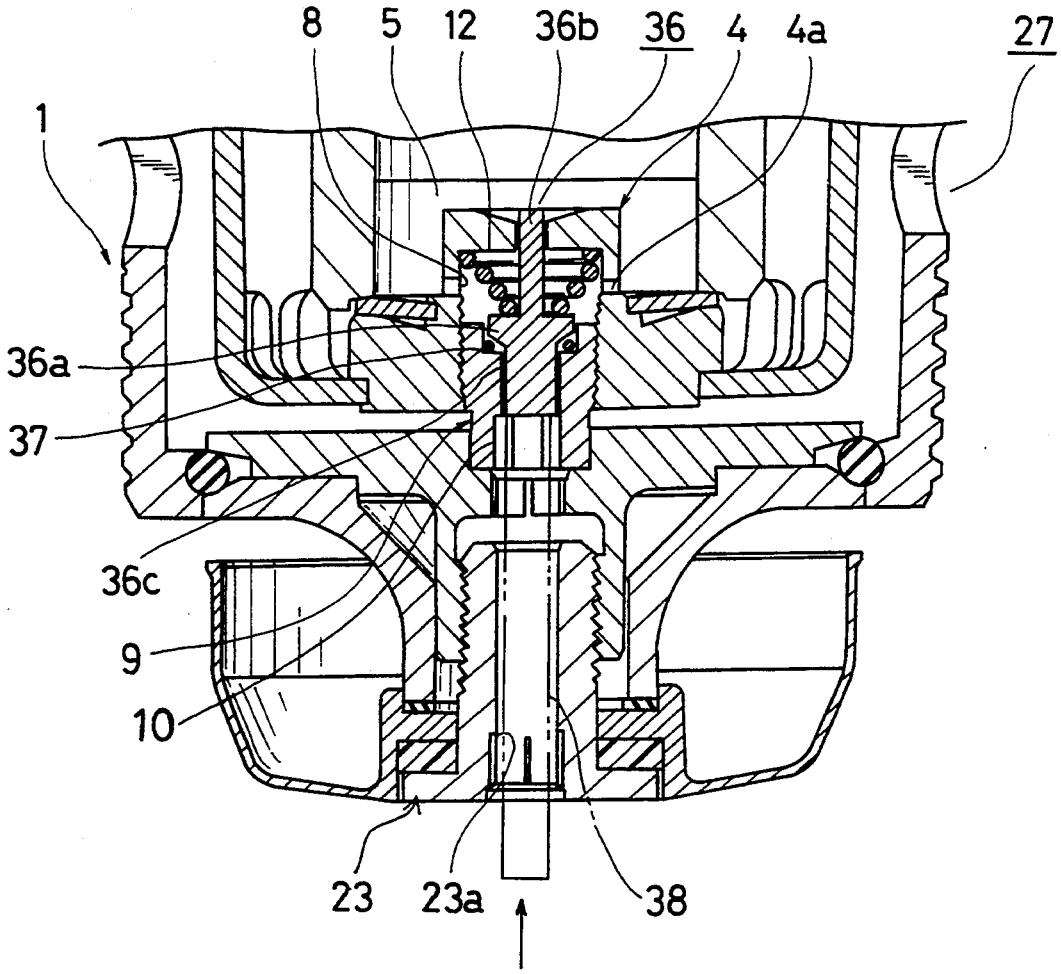
FIG. 7 is an partially enlarged sectional view illustrating an actual use of the sprinkler head of FIG. 6.

In FIG. 6, a plurality of holes 4*a* are defined above the collar portion 6 of the plug 4, each of which extends in a radial direction. A valve 36 includes a diametrally small portion defined on its lower end which is inserted into the through-hole 10 of the externally threaded portion 9, a valve body 36*c* having a diametrally large valve seat 36*a* defined on an upper end of the valve 36, the elastic member 12 of the conical coil spring which is mounted above the valve seat 36*a*. As a usual position of this arrangement, the valve body 36*c* is pressed outwardly by the elastic member 12, causing the presence applied over the vale seat 36*a* and the stepped portion defined in the through-hole 10 of the extendable threaded portion 9 via the O-ring 37, then closing the through-hole 10.

A pin 36*b* is provided on an upper surface of the valve seat 36*a*, and is inserted into a diametrally small portion defined in an upper end of the through-hole 8 of the plug 4. A length of the pin 36*b* is determined such that an upper end thereof protrudes slightly and inwardly away from the upper surface of the plug 4 by a relatively short length, when the valve body 36*c* is pressed upwardly, while resisting the spring force of the elastic member 12.

A sealing means is applied to an outward surface of the valve seat 36*a*. An outer diameter of each of the lower ends of the valve body 36*c* and the pin 36*b* is slightly smaller than an inner diameter of the through-hole 10.

In accordance with the above-defined arrangement, when the filled state of the fire protection water has to be checked, a pushing rod 38 of a suitable length is inserted into the through-hole 23*a* of the lock screw 23 to push a lower surface of the valve body 36*c*, while resisting the spring force of the elastic member 12. Whereby, the valve body 36*c* is moved upwardly such that a sealing condition between the valve seat 36*a* and the externally threaded portion 9 is released. Subsequently, a relatively little amount of the fire protection water drops out of the through-hole 23*a* of the lock screw 23 via the outlet port 5 of the sprinkler head body 27, the through-hole 8 of the plug 4 and the through-hole 10 of the externally threaded portion 9.

Further, the pin 36*b* of the valve body 36*c* protrudes away from the through-hole 8 of the plug 4 by pressing the valve body 36*c*. Whereby, even if undesirable foreign materials such as a rubbish of a particular size are accumulated on the through-hole 8, they can be removed from the through-hole 8 by the motion of the pin 36*b*.

After confirming that the fire protection water has been dropped, the pushing rod 38 is pulled out of the through-hole 23*a* of the lock screw 23 to release the pressure applied over the valve body 36*c*, and subsequently return the valve body 36*c* to an initial position by a restoring force of the elastic member 12. Thus, the through-hole 10 of the externally threaded portion 9 is closed to stop the dropping of the fire protection water. A seal for indicating that the filled state of the water has been tested, is bonded onto the through-hole 23*a*, which simultaneously serves to close the through-hole 23*a*.

That the fire protection water does not drop out of the through-hole 23*a*, indicates an unfilled state of the fire protection water, and insufficient connecting of the pipes or other accidents in communicating the water. In this case, the piping or the like is checked again and the filled state of the water is subsequently tested in the same manner as described above.

Thus, the filled state of the fire protection water inside of the sprinkler head body 27 can be readily checked by such an extremely simple operation. A series of checking operations are generally made just after the piping has been completed. However, it is a matter of course that they can be periodically made.

Figure 8:
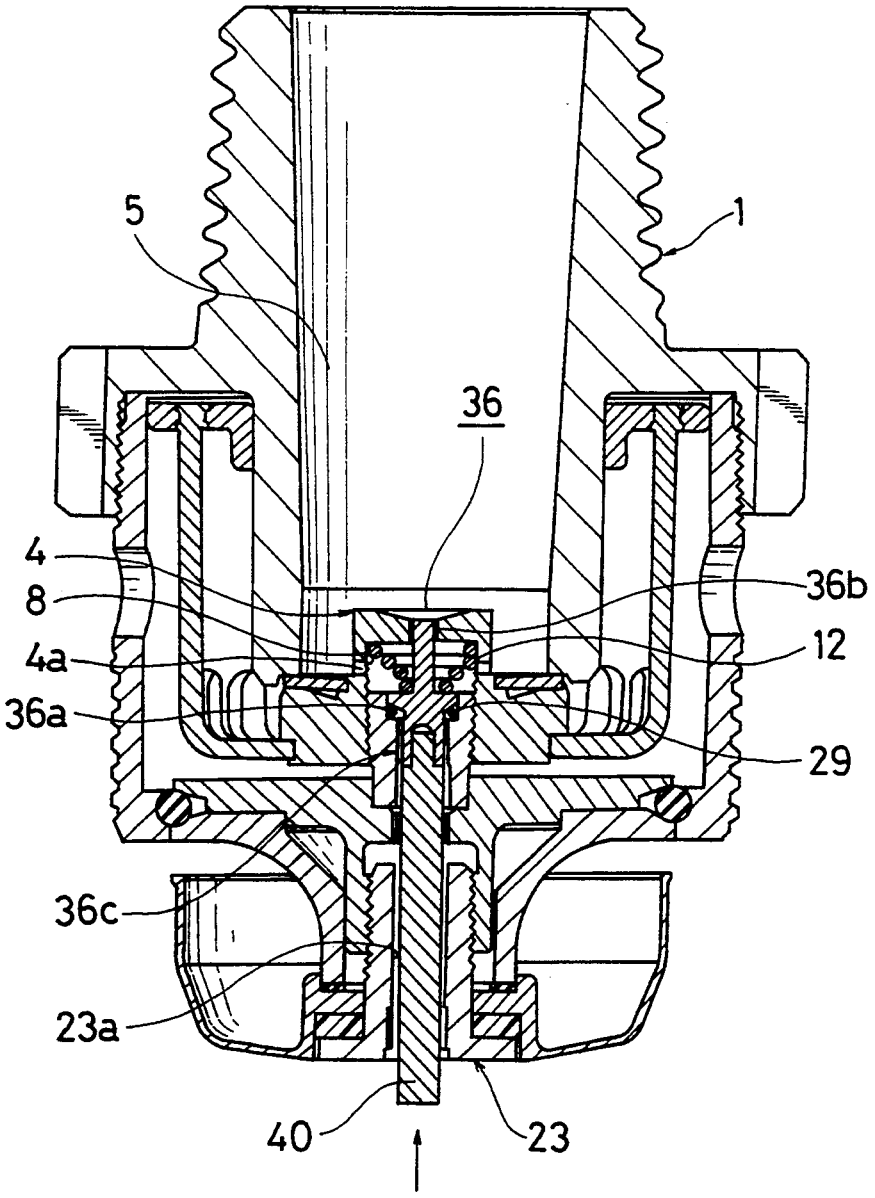
FIG. 8 is a sectional view illustrating a still further embodiment of the present invention.
Figure 9:
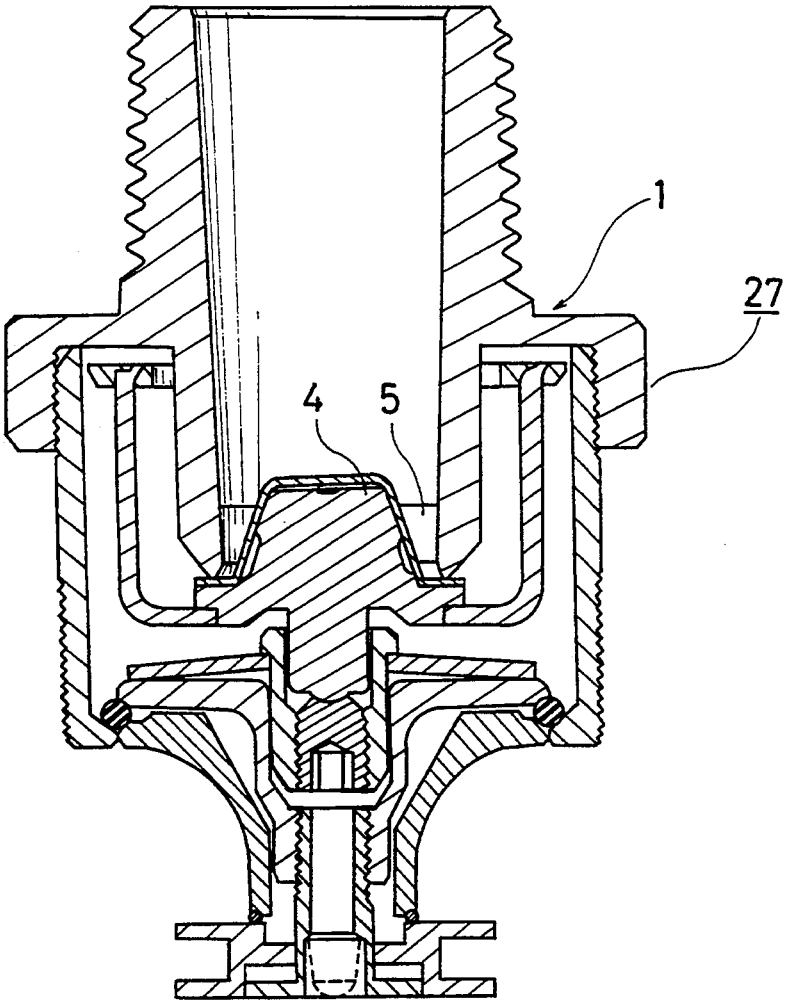
FIG. 9 PRIOR ART
FIG. 9 is a sectional view illustrating a conventional sprinkler head.

The valve 36 of the present invention is not limited to this arrangement by all means, and it is essential to open and close the through-hole 8 defined in the plug 4 with the valve 36. However, when the valve 36 comprises the valve body 36*a* and the elastic member 12, a pushing member 40 can be formed integrally with the valve body 36*c* by fixing an end of the pushing member 40 to the lower surface of the valve body 36*c*, in which the other end of the pushing member 40 can protrude outwardly away from the through-hole 23*a* of the lock screw 23, as illustrated in FIG. 8.

In addition, the externally threaded portion 9 can be omitted such that the valve body 36*c* can open and close the through-hole 8 of the plug 4. In this case, the pug 4, the valve body 36*c*, the elastic member 12 or other elements are formed such that the valve body 36*c* and the elastic member 12 can be mounted inside of the through-hole 10 from above of the plug 4.

Further, the elastic member 12 is not limited to the conical coiled spring, and any means can be employed for the elastic member 12 of the conical coil spring. It is essential to press the valve body 36c by the elastic member 12.

Further, the present invention is not limited to the above described embodiments. It can be supplied to the dry sprinkler head.

In this case, the fire protection water, which has been undesirably accumulated inside of the head frame 1, can be drained out of the head frame 1 by opening and closing the valve 36, which leads to another advantage of the present invention.

In addition, a specific arrangement such as a shape of the plug 4 can be fully designed within the scope of the present invention.

This specification is by no means intended to restrict the present invention to the preferred embodiments set forth therein. Various modifications to the inventive sprinkler head having the checking means for checking that the fluid has been filled inside of the sprinkler head body and the method for checking that the fluid has been filled, as described herein, may be made by those skilled in the art without departing from the spirit and scope of the present invention.

What is claimed is:

1. A sprinkler head comprising a sprinkler head body and a checking means for checking from the outside that fluid has been filled inside of said sprinkler head body, wherein said checking means is a movable rod which is usually positioned inside of said sprinkler head body and is urged inwardly with an elastic member inside of a through-hole defined in a plug adapted for closing an outlet port of a head frame, and an end of said movable rod protrudes outwardly away from said sprinkler head body while resisting a spring force of said elastic member, after said fluid has been filled inside of said sprinkler head body.

2. A sprinkler head comprising a sprinkler head body and a checking means for checking from the outside that fluid has been filled inside of said sprinkler head body, said checking means being a movable rod which is usually positioned inside of said sprinkler head body and is arranged such that it protrudes outwardly away from said sprinkler head body after said fluid has been filled inside of said sprinkler head body, said movable rod being positioned in an axial center of said sprinkler head body.

3. A sprinkler head comprising a sprinkler head body and a checking means for checking from the outside that fluid has been filled inside of said sprinkler head body, said checking means being a movable rod which is usually positioned outside of said sprinkler head body urged outwardly by an elastic member and is drawn inside said sprinkler head body by fluid pressure acting on an inner surface thereof while resisting a spring force of said elastic member after said fluid has been filled inside of said sprinkler head body.

4. A sprinkler head comprising a sprinkler head body and a checking means for checking from the outside that fluid has been filled inside of said sprinkler head body, wherein said checking means comprises a plug adapted for closing an outlet port of a head frame, a through-hole defined in said plug, said outlet port and said through-hole being in fluid communication with each other, an outwardly threaded portion threaded into said through-hole of said plug, a movable rod which is inserted into a through hole defined in said outwardly threaded portion so as to be axially movable, and is urged outwardly with an elastic member as a usual state so as to protrude outwardly away from said sprinkler head body, a passageway defined axially in said movable rod, a space defined by a side periphery of said movable rod and an inner periphery of said outwardly threaded portion, wherein said space and said passageway are in fluid communication with each other so as to introduce said movable rod into said sprinkler head body, while resisting a spring force of said elastic member.

5. A sprinkler head comprising a sprinkler head body and a checking means for checking from the outside that fluid has been filled inside of said sprinkler head body, said checking means being a movable rod which is usually positioned outside of said sprinkler head body and is drawn inside said sprinkler head body after said fluid has been filled inside of said sprinkler head body, said movable rod being positioned in an axial center of said sprinkler head body.

6. A sprinkler head comprising a sprinkler head body and a checking means for checking from the outside that fluid has been filled inside of said sprinkler head body, wherein said checking means comprises a plug adapted for closing an outlet port of a head frame, a valve adapted for opening and closing a through-hole defined in said plug, said through-hole and said outlet port of said frame being in fluid communication with each other.

7. The sprinkler head as set forth in claim 6, wherein said valve comprises a valve body mounted in said through-hole of said plug, and an elastic member adapted for closing said through-hole of said plug by pressing said valve body outwardly.

8. The sprinkler head as set forth in claim 7, wherein a pushing member is mounted on a lower end of said valve body so as to push said valve body, while resisting a spring force of said elastic member.

9. A sprinkler head comprising a sprinkler head body and a checking means for checking from the outside that fluid has been filled inside of said sprinkler head body, wherein said checking means comprises a plug adapted for closing an outlet port of a head frame, an outwardly threaded portion threaded into a lower portion of a through-hole defined in said plug, said through-hole of said plug and said outlet port being in fluid communication with each other, a valve adapted for opening and closing a through-hole defined in said outwardly threaded portion, said through-hole in said outwardly threaded portion and said through-hole of said plug being in fluid communication with each other.

10. The sprinkler head as set forth in claim 9, wherein said valve comprises a valve body mounted in said through-hole of said outwardly threaded portion, and an elastic member adapted for closing said through-hole of said outwardly threaded portion by pressing said valve body outwardly.

11. The sprinkler head as set forth in claim 10, wherein a pin is provided on an upper surface of said valve body, and is inserted into an upper portion of said through-hole of said plug, wherein a diameter of said upper portion of said through-hole is smaller than a diameter of its lower portion.

12. The sprinkler head as set forth in claim 11, wherein an upper end of said pin protrudes outwardly away from said through-hole of said plug, while resisting a spring force of said elastic member when said valve body has been pressed by an external rod.

13. A method for checking that fluid has been filled comprising connecting a sprinkler head to a distributing water pipe, wherein an outlet port of a sprinkler head body is closed with a plug, communicating fluid to said distributing water pipe, opening a valve adapted for opening and closing a through-hole defined in said plug, said through-hole and said outlet port of said sprinkler head body being in fluid communication with each other, and checking that said fluid has been filled inside of said sprinkler head body by observing said fluid dropped from said through-hole of said plug.

* * * * *